US011346045B2

(12) United States Patent
Freitag

(10) Patent No.: US 11,346,045 B2
(45) Date of Patent: May 31, 2022

(54) METHODS AND SYSTEMS FOR PROTECTING LAUNDRY

(71) Applicant: Cheryl J M Freitag, Mankato, MN (US)

(72) Inventor: Cheryl J M Freitag, Mankato, MN (US)

(73) Assignee: Cheryl J M Freitag, Mankato, MN (US)

( * ) Notice: Subject to any disclaimer, the term of this patent is extended or adjusted under 35 U.S.C. 154(b) by 328 days.

(21) Appl. No.: 16/739,996

(22) Filed: Jan. 10, 2020

(65) Prior Publication Data

US 2020/0240073 A1 Jul. 30, 2020

Related U.S. Application Data

(60) Provisional application No. 62/797,702, filed on Jan. 28, 2019.

(51) Int. Cl.
*D06F 95/00* (2006.01)

(52) U.S. Cl.
CPC ..... *D06F 95/008* (2013.01); *D06F 95/002* (2013.01)

(58) Field of Classification Search
CPC ..... D06F 95/002
See application file for complete search history.

(56) References Cited

U.S. PATENT DOCUMENTS

2013/0098120 A1* 4/2013 Lander ..... D06F 95/008 68/235 R

* cited by examiner

*Primary Examiner* — Jason Y Ko
(74) *Attorney, Agent, or Firm* — Stinson LLP

(57) ABSTRACT

A laundry accessory protects laundry. The laundry accessory includes a body defining a cavity therein. The body includes a base and one or more sidewalls extending generally upward from the base. A plurality of rails are coupled to an upper portion of the sidewalls. The rails define a gateway in fluid communication with the cavity, and a gate is slidably coupled to the rails to selectively close the gateway for containing a solid object, such as a piece of laundry, in the cavity.

20 Claims, 5 Drawing Sheets

FIG. 1
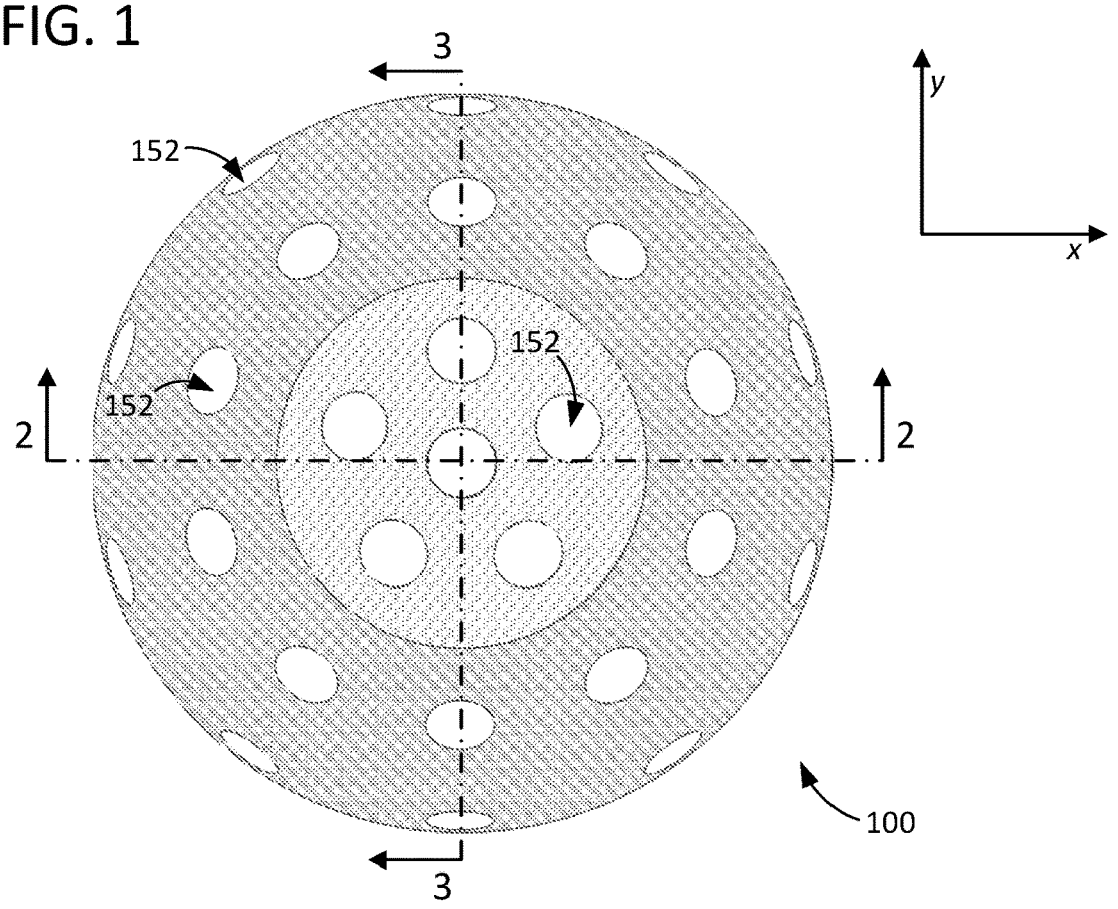
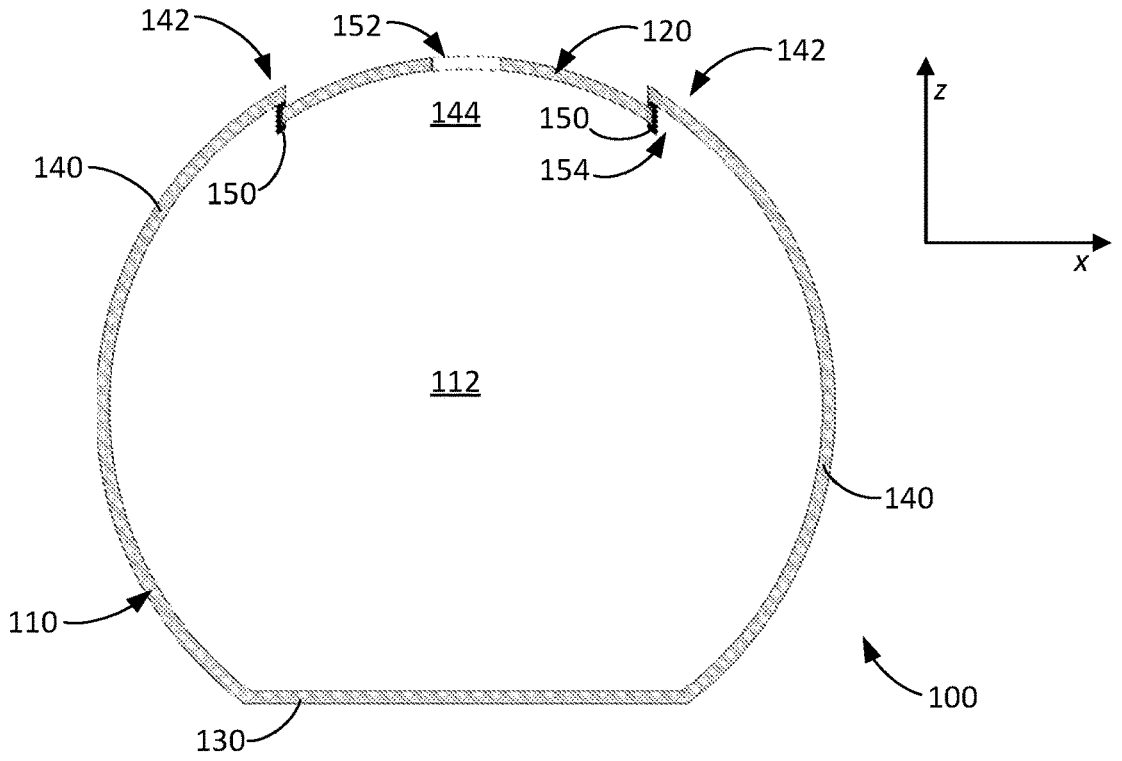
FIG. 2

METHODS AND SYSTEMS FOR PROTECTING LAUNDRY

CROSS-REFERENCE TO RELATED APPLICATIONS

This patent application claims priority to U.S. Provisional Patent Application Ser. No. 62/797,702, filed Jan. 28, 2019, which is hereby incorporated by reference in its entirety.

BACKGROUND

Clothes, bedding, and/or other pieces of laundry may be washed, rinsed, and/or dried using laundry machines, such as washing machines and drying machines. Known laundry machines include a chamber or drum that rotates to slosh, propel, and/or mix laundry therein, forcing pieces of laundry to collide with each other and/or with the walls of the drum. To handle various types of laundry, some known laundry machines provide a multitude of options for setting operating speeds, operating times, operating temperatures, load sizes, and/or number of cycles. However, selecting each option for every load of laundry may be tiresome, tedious, and/or time-consuming. Moreover, at least some pieces of laundry may be difficult to locate or retrieve after being sloshed, propelled, and/or mixed freely within the drum of a laundry machine.

SUMMARY

Examples of the disclosure enable laundry to be protected. In one aspect, a laundry accessory is provided. The laundry accessory includes a body defining a cavity therein. The body includes a base and one or more sidewalls extending generally upward from the base. A plurality of rails are coupled to an upper portion of the sidewalls. The rails define a gateway in fluid communication with the cavity, and a gate is slidably coupled to the rails to selectively close the gateway for containing a solid object in the cavity.

In another aspect, a container is provided for protecting laundry. The container includes a planar base, one or more arcuate sidewalls extending generally upward from the planar base to at least partially define a cavity sized to accommodate the laundry, a plurality of rails coupled to an upper portion of the arcuate sidewalls, and a gate coupled to the rails. The rails define a gateway in fluid communication with the cavity, and the gate is coupled to the rails such that the gate is slidable between an open position, in which the laundry is allowed to move through the gateway, and a closed position, in which the laundry is restricted from moving through the gateway.

In yet another aspect, a method is provided for manufacturing an accessory for protecting laundry. The method includes forming a body including a planar base and one or more arcuate sidewalls extending generally upward from the planar base to at least partially define a cavity sized to accommodate the laundry, coupling a plurality of rails to an upper portion of the arcuate sidewalls such that the rails define a gateway in fluid communication with the cavity, and coupling a gate to the plurality of rails such that the gate is slidable between an open position, in which the laundry is allowed to move through the gateway, and a closed position, in which the laundry is restricted from moving through the gateway.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 1 includes a top plan view of an example laundry accessory in a first configuration.

FIG. 2 includes a front sectional view of the laundry accessory shown in FIG. 1 in the first configuration.

Figure 3:
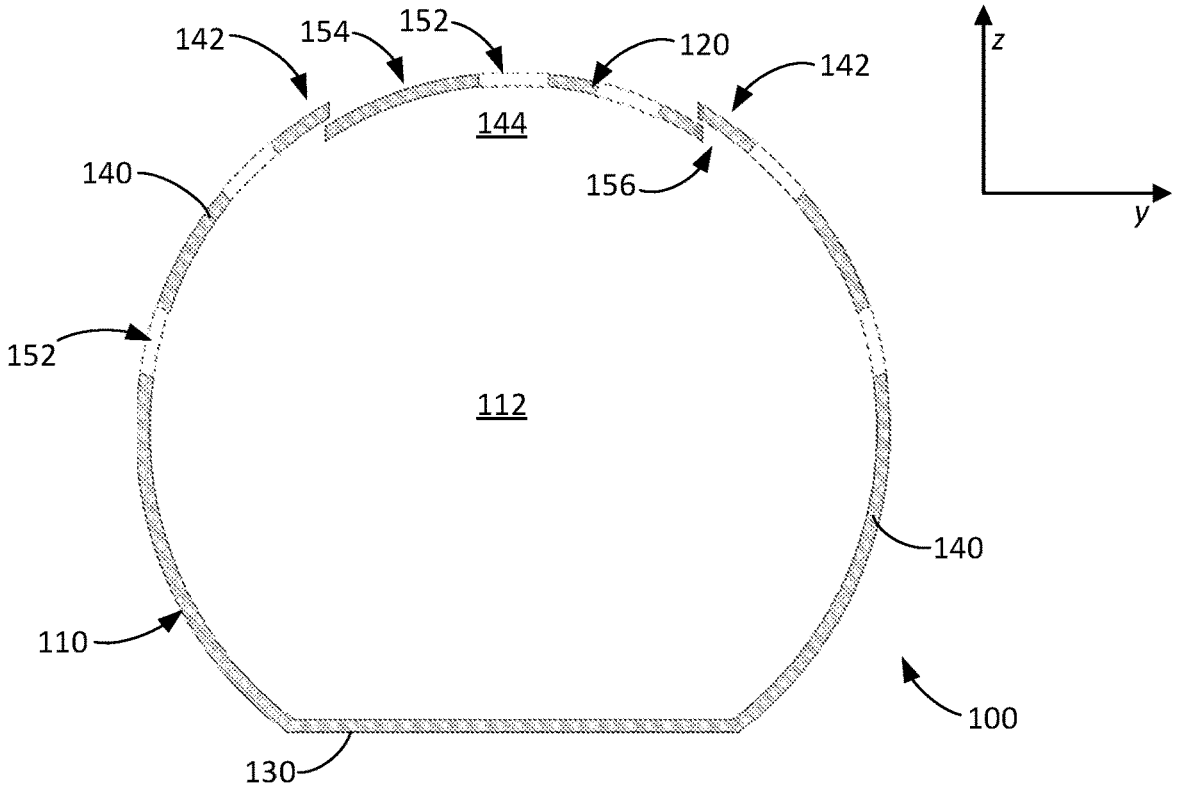
FIG. 3 includes a right sectional view of the laundry accessory shown in FIG. 1 in the first configuration.

Corresponding reference characters indicate corresponding parts throughout the drawings. Although specific features may be shown in some of the drawings and not in others, this is for convenience only. In accordance with the examples described herein, any feature of a drawing may be referenced and/or claimed in combination with any feature of any other drawing.

DETAILED DESCRIPTION

The present disclosure relates to laundry devices and, more particularly, to methods and systems for protecting laundry. Examples described herein include a laundry accessory that restrains, separates, and/or protects laundry, for example, to mitigate entanglement, damage, and/or loss during washing, rinsing, and/or drying. The laundry accessory includes a body defining a cavity and a gate that selectively keeps laundry housed in the cavity from colliding with paddles, ribs, walls, and/or other features of a laundry machine, as well as with other laundry being washed, rinsed, and/or dried in the laundry machine. Moreover, the laundry accessory includes a plurality of openings and/or surface features that allow fluid to pass through and/or about the cavity (e.g., for washing, rinsing, and/or drying laundry within the cavity). While the examples described herein are described with respect to protecting laundry, one of ordinary skill in the art would understand and appreciate that the example systems and methods may be used to separate any solid object from other solid objects, while allowing it to interact with fluids, such as air and water.

Figure 4:
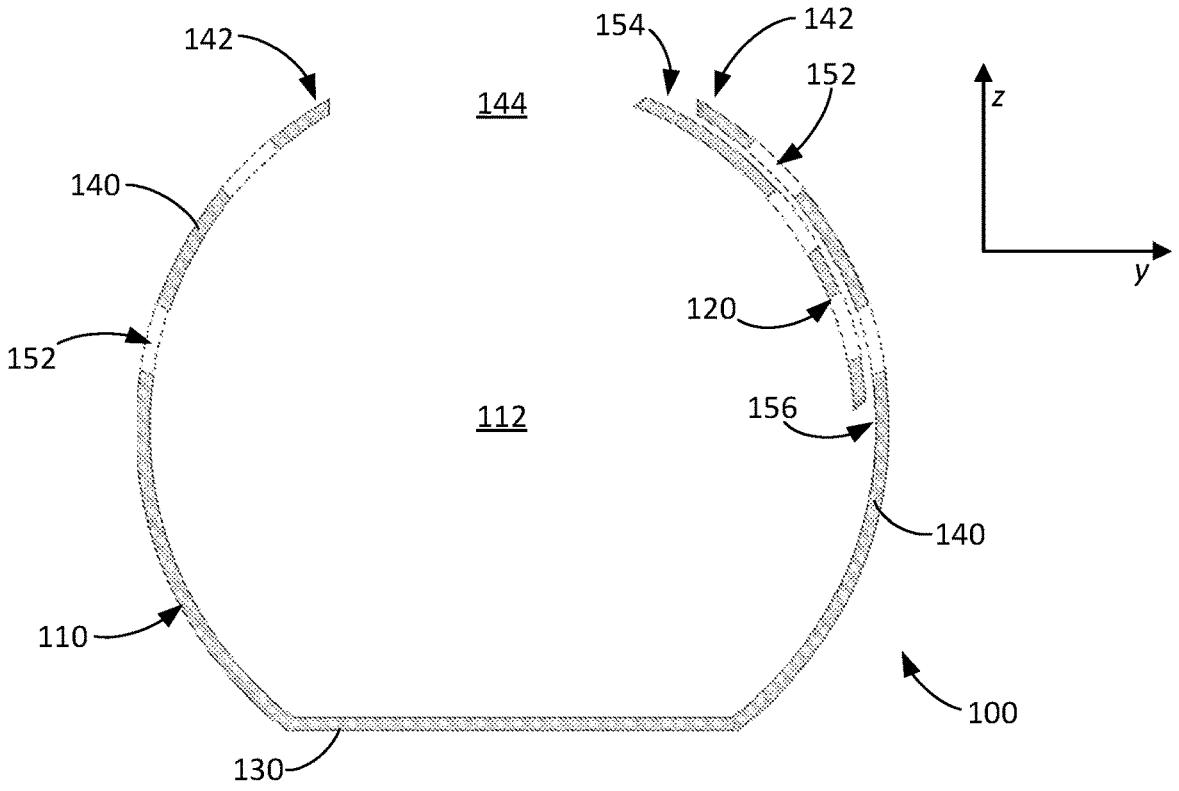
FIG. 4 includes a right sectional view of the laundry accessory shown in FIG. 1 in a second configuration.

FIGS. 1-4 show an example container or laundry accessory 100. FIG. 2 shows a cross-section of the laundry accessory 100 taken along line 2-2, and FIG. 3 shows a cross-section of the laundry accessory 100 taken along line 3-3. As shown in FIGS. 2-4, the laundry accessory 100 includes a body 110 defining a cavity 112 therein and a gate 120 moveable to selectively allow a solid object (e.g., laundry) to be housed or contained in the cavity 112, which is sized to accommodate the solid object. FIGS. 1-3 show the gate 120 in a closed position, and FIG. 4 shows the gate 120 in an open position.

As shown in FIGS. 2-4, the body 110 includes a base 130 and one or more sidewalls 140 coupled to the base 130. In some examples, the sidewalls 140 extend from the base 130 such that an upper portion 142 of the sidewalls 140 at least partially define a gateway 144 in fluid communication with the cavity 112. The base 130 extends generally in the horizontal plane (e.g., in the XY plane) and has a planar or substantially planar configuration, and the sidewalls 140 extend generally upward (e.g., toward a positive direction along the Z axis) from the base 130 and have a curved or arcuate (e.g., concave) configuration, such that the body 110 forms a spherical segment (e.g., a portion of a sphere above and/or below one or more given planes). The base 130 allows the laundry accessory 100 to be securely positioned (e.g., without rolling) on a flat or substantially planar surface. The body 110 may have a radially symmetrical configuration (e.g., relative to a center axis extending in a direction along the Z-axis). Alternatively, the base 130 and/or sidewalls 140 may have any shape, size, and/or configuration that enables the body 110 to function as described herein.

As shown in FIG. 2, the gate 120 is coupled to a plurality of rails 150 that at least partially define the gateway 144. The rails 150 may be coupled, for example, to the upper portion 142 of the sidewalls 140. The rails 150 are positioned and/or oriented such that the gate 120 extends generally in the horizontal plane (e.g., in the XY plane) opposite the base 130 such that the sidewalls 140 extend generally downward (e.g., toward a negative direction along the Z axis) from the gate 120 (e.g., when the gate 120 is in the closed position). The gate 120 may be slidably coupled to the rails 150 such that the gate 120 is positionable in a closed position (shown, e.g., in FIGS. 1-3), in which the gate 120 generally extends across the gateway 144, or in an open position (shown, e.g., in FIG. 4), in which the gate 120 does not extend across at least a portion of the gateway 144.

When the gate 120 is in the closed position, solid objects (e.g., laundry) are restricted or prevented from passing through the gateway 144. The gate 120 may be moved away from the closed position and/or toward the open position to selectively open the gateway 144 (e.g., for inserting laundry into or removing laundry from the cavity 112). In some examples, the rails 150 restrict or prevent the gate 120 from being removed therefrom. Additionally, the laundry accessory 100 may include one or more biasing mechanisms (e.g., spring, magnet) that bias the gate 120 toward the closed position and/or away from the open position (e.g., for containing laundry in the cavity 112).

As shown in FIGS. 1-4, the gate 120, base 130, and/or sidewalls 140 include a plurality of openings 152 extending therethrough. The openings 152 are sized to allow fluid (e.g., air, liquid) to pass therethrough while restricting certain solid objects (e.g., laundry) from passing therethrough. The openings 152 have a width or diameter, for example, that is smaller than a width or diameter of the gateway 144. The openings 152 may be arranged or disposed to allow or encourage one or more fluid flow parameters or patterns (e.g., flow direction, flow velocity, streamline) In some examples, the gate 120, base 130, and/or sidewalls 140 are fabricated from one or more perforated materials and/or a plurality of strands attached in an openwork arrangement (e.g., net, mesh, lattice).

Additionally, the gate 120, base 130, and/or sidewalls 140 may include a plurality of surface features (e.g., fins, ridges, bumps, grooves, dimples) to control or affect one or more fluid flow patterns and/or movement of solid objects. For example, surface features at an inner surface of the gate 120, base 130, and/or sidewalls 140 may affect one or more fluid flow patterns and/or movement of solid objects within the cavity 112. Additionally or alternatively, surface features at an outer surface of the gate 120, base 130, and/or sidewalls 140 may affect one or more fluid flow patterns and/or movement of solid objects outside the cavity 112.

In some examples, the laundry accessory 100 includes one or more control mechanisms that manage or control a shape, size, and/or configuration of the openings 152 and/or surface features. The control mechanisms may adjust, for example, a size and/or position of the openings 152 and/or surface features (e.g., for controlling or affecting one or more fluid flow patterns and/or movement of solid objects). Example control mechanisms include sensors, valves, springs, magnets, switches, and/or stimuli-responsive polymers.

Figure 5:
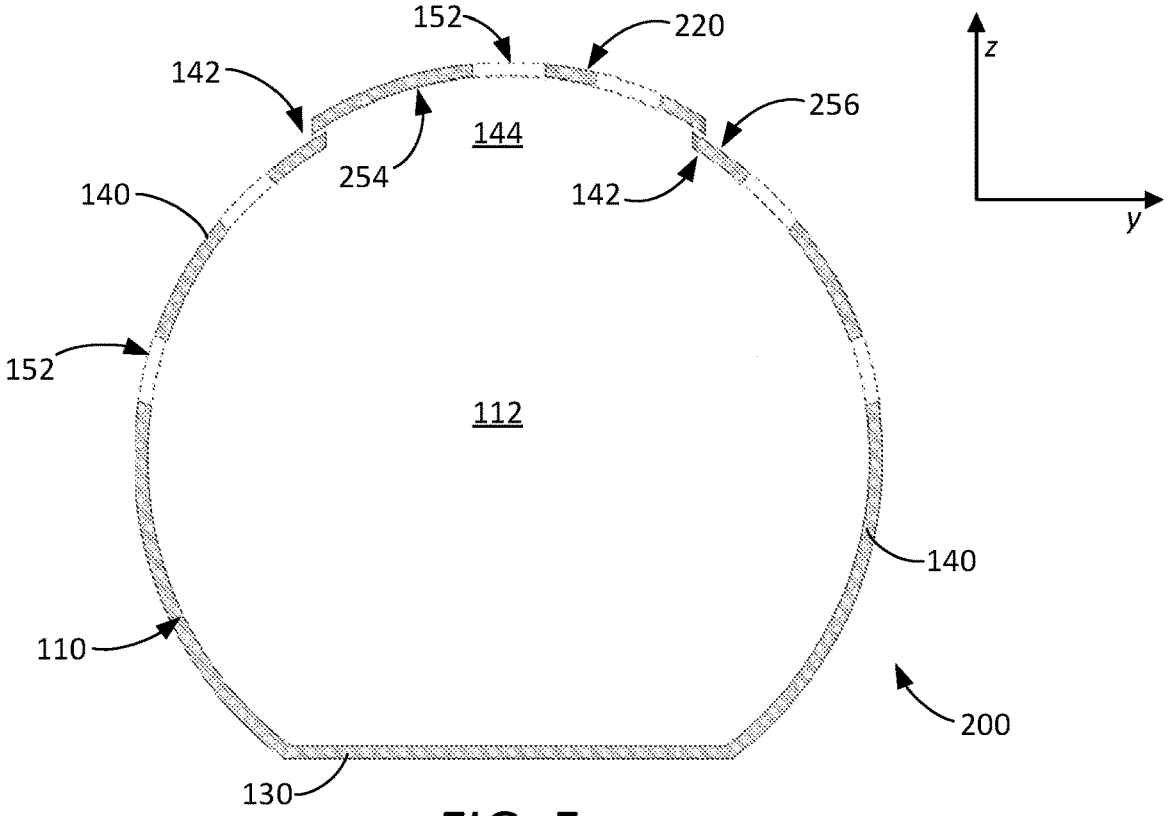
FIG. 5 includes a right sectional view of another example laundry accessory in a first configuration.
Figure 6:
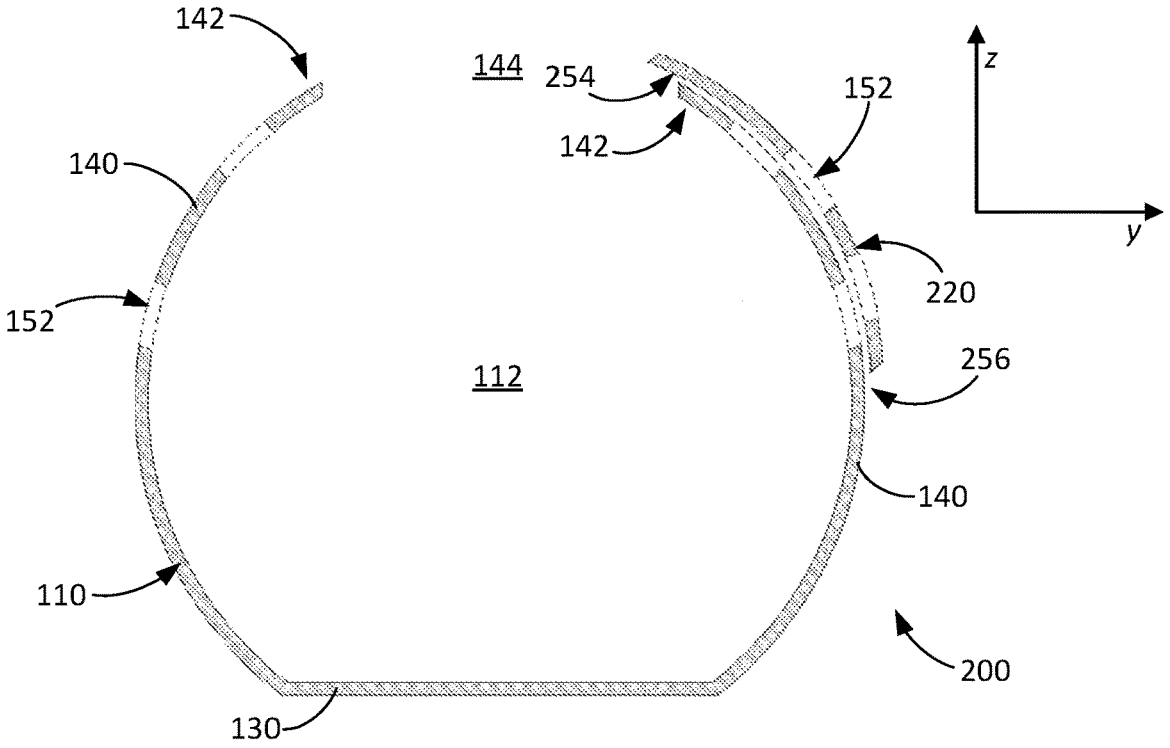
FIG. 6 includes a right sectional view of the laundry accessory shown in FIG. 5 in a second configuration.
Figure 7:
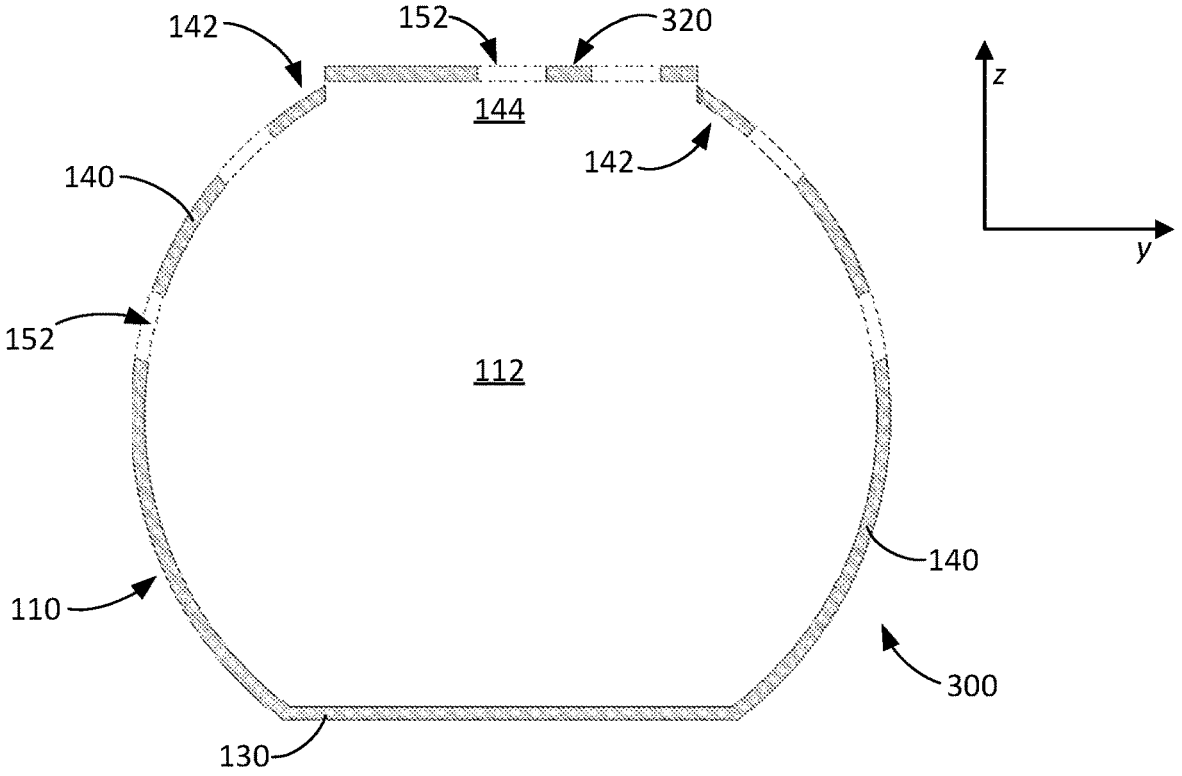
FIG. 7 includes a right sectional view of yet another example laundry accessory in a first configuration.
Figure 8:
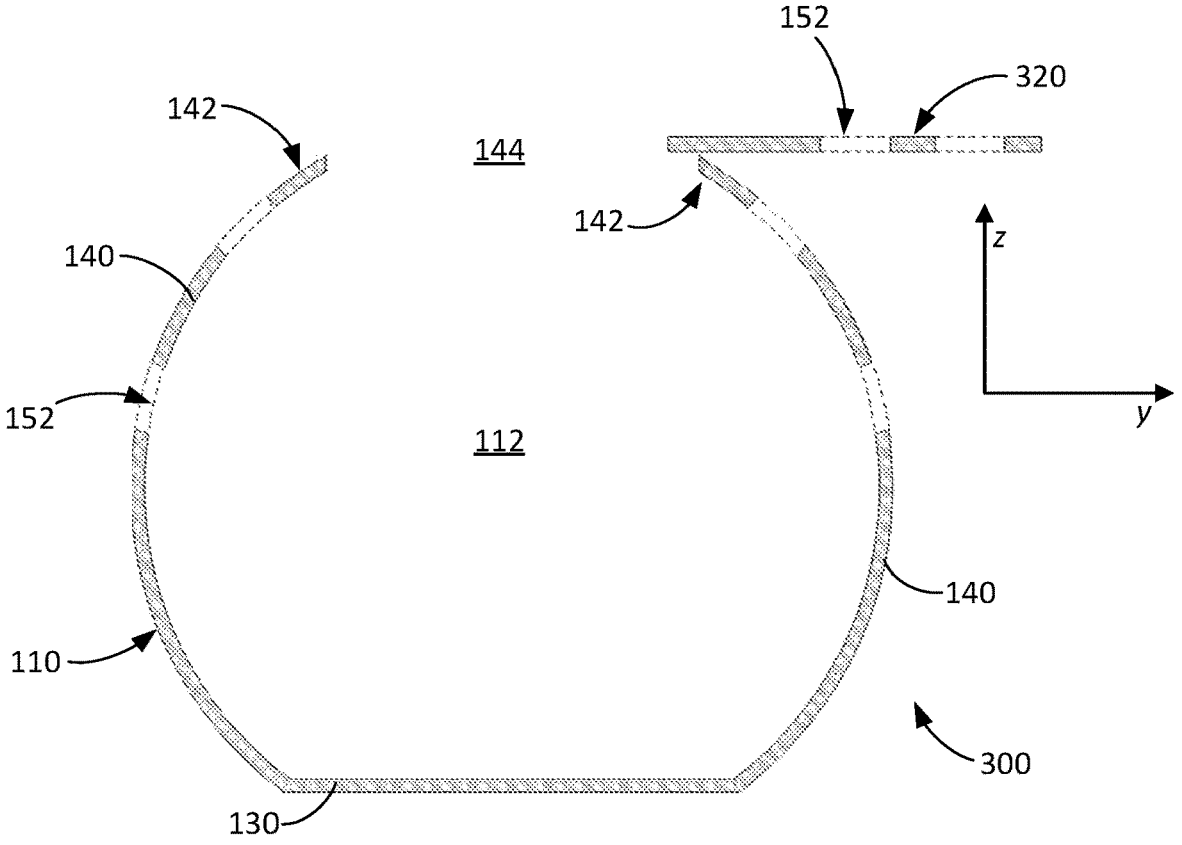
FIG. 8 includes a right sectional view of the laundry accessory shown in FIG. 7 in a second configuration.

In some examples, the gate 120 and/or rails 150 have a reduced profile (e.g., relative to the sidewalls 140). In this manner, laundry is not prone to catch or tear on the gate 120 and/or rails 150. For example, the gate 120 and/or rails 150 may have a curved or arcuate (e.g., concave) configuration that is contoured to complement the sidewalls 140. As shown in FIGS. 2-4, this configuration allows the gate 120 to be positioned radially inward of and similar to the sidewalls 140 such that an outer surface 154 of the gate 120 faces an inner surface 156 of the sidewalls 140 when the gate 120 is in the open position. As shown in FIGS. 5 and 6, this configuration also allows a laundry accessory 200, which is otherwise the same as or substantially similar to the laundry accessory 100, to include a gate 220 that is positionable radially outward of and similar to the sidewalls 140 such that an inner surface 254 of the gate 220 faces an outer surface 256 of the sidewalls 140 when the gate 220 is in the open position. FIG. 5 shows the gate 220 in a closed position, and FIG. 6 shows the gate 220 in an open position. Alternatively, the gate 120 and/or rails 150 may have any other shape, size, and/or configuration that allows the gate 120 to selectively restrict a solid object (e.g., laundry) from passing through the gateway 144. For example, as shown in FIGS. 7 and 8, a laundry accessory 300, which is otherwise the same as or substantially similar to the laundry accessory 100 and/or laundry accessory 200, includes a gate 320 having a planar or substantially planar configuration. FIG. 7 shows the gate 320 in a closed position, and FIG. 8 shows the gate 320 in an open position.

Figure 9:
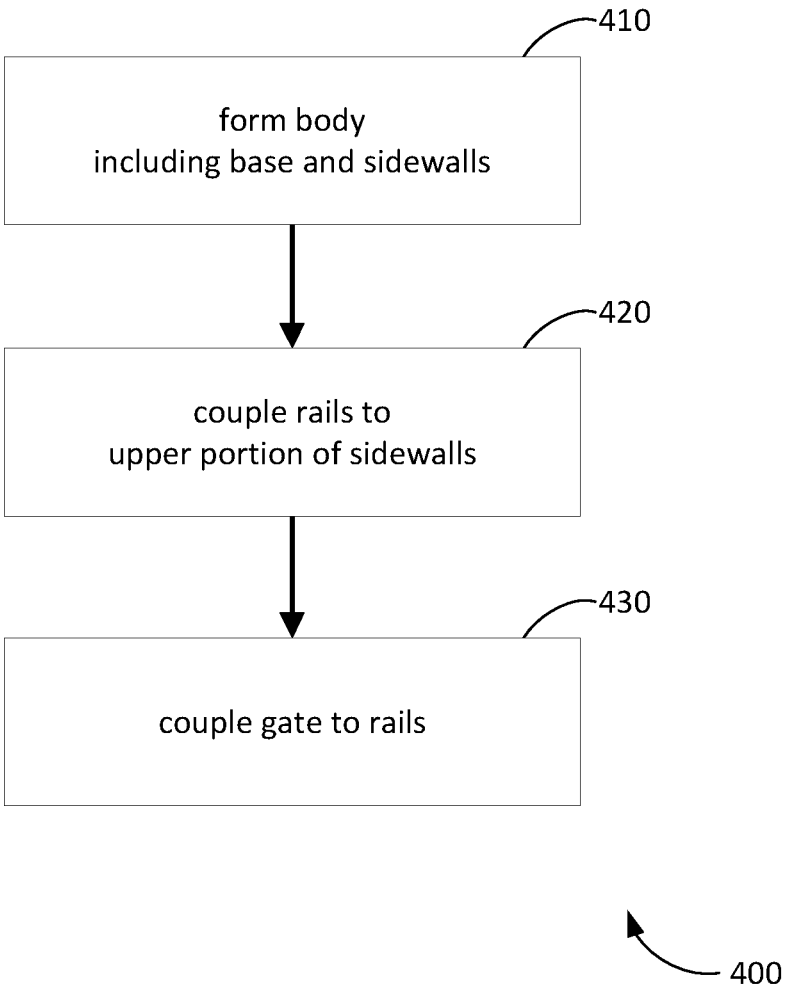
FIG. 9 includes a flowchart of an example method of manufacturing an accessory for protecting laundry, such as the laundry accessories shown in FIGS. 1-8.

FIG. 9 shows an example method 400 of manufacturing an accessory for protecting laundry (e.g., laundry accessory 100, laundry accessory 200, laundry accessory 300). A body (e.g., body 110) is formed at operation 410. The body 110 may include, for example, a planar base (e.g., base 130) and/or one or more arcuate sidewalls (e.g., sidewalls 140). The sidewalls 140 extend generally upward from the base 130 to at least partially define a cavity 112 sized to accommodate one or more solid objects (e.g., laundry).

A plurality of rails (e.g., rails 150) are coupled to an upper portion of the sidewalls 140 (e.g., upper portion 142) at operation 420. The rails 150 may be coupled to the upper portion 142 such that the rails 150 define a gateway (e.g., gateway 144) that provides access to the cavity 112. A gate (e.g., gate 120) is coupled to the rails 150 at operation 430. The gate 120 may be slidable between an open position, in which laundry is allowed to move through the gateway 144, and a closed position, in which laundry is restricted from moving through the gateway 144. In some examples, one or more biasing mechanisms urge the gate 120 to move toward the closed position and/or away from the open position.

The gate 120 may be moved to selectively house or contain laundry within the cavity 112, and the laundry accessory 100 may be positioned in a laundry machine (e.g., for washing, rinsing, and/or drying laundry in the cavity 112). For example, openings 152 defined in the gate 120, base 130, and/or sidewalls 140 may allow water (e.g., for washing or rinsing laundry in the cavity 112) or air (e.g., for drying laundry in the cavity 112) to pass therethrough.

Example laundry devices are described herein and illustrated in the accompanying drawings. The examples described herein allow laundry to be washed, rinsed, and/or dried in a washing machine, a drying machine, and/or other laundry machine in a convenient and user-friendly manner, as well as a garment-friendly (e.g., gentle) manner. The laundry accessory described herein has certain features that protect laundry from one or more objects, including the laundry machine and/or other pieces of laundry, and mitigate entanglement, damage, and/or loss. The laundry accessory may be used, for example, to wash, rinse, and/or dry delicate garments and/or socks. This written description uses examples to disclose aspects of the disclosure and also to enable a person skilled in the art to practice the aspects, including making or using the above-described systems and executing or performing the above-described methods.

Having described aspects of the disclosure in terms of various examples with their associated operations, it will be apparent that modifications and variations are possible without departing from the scope of the disclosure as defined in the appended claims. That is, aspects of the disclosure are not limited to the specific examples described herein, and all matter contained in the above description and shown in the accompanying drawings shall be interpreted as illustrative and not in a limiting sense. For example, the examples described herein may be implemented and utilized in connection with many other applications.

Components of the systems and/or operations of the methods described herein may be utilized independently and separately from other components and/or operations described herein. Moreover, the methods described herein may include additional or fewer operations than those disclosed, and the order of execution or performance of the operations described herein is not essential unless otherwise specified. That is, the operations may be executed or performed in any order, unless otherwise specified, and it is contemplated that executing or performing a particular operation before, contemporaneously with, or after another operation is within the scope of the disclosure. Although specific features of various examples of the disclosure may be shown in some drawings and not in others, this is for convenience only. In accordance with the principles of the disclosure, any feature of a drawing may be referenced and/or claimed in combination with any feature of any other drawing.

When introducing elements of the disclosure or the examples thereof, the articles "a," "an," "the," and "said" are intended to mean that there are one or more of the elements. References to an "embodiment" or an "example" of the present disclosure are not intended to be interpreted as excluding the existence of additional embodiments or examples that also incorporate the recited features. The terms "comprising," "including," and "having" are intended to be inclusive and mean that there may be elements other than the listed elements. The phrase "one or more of the following: A, B, and C" means "at least one of A and/or at least one of B and/or at least one of C."

The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A laundry accessory comprising:

a body defining a cavity therein, the body including a base and one or more sidewalls extending generally upward from the base;

a plurality of rails coupled to an upper portion of the one or more sidewalls, the plurality of rails defining a gateway in fluid communication with the cavity; and a gate slidably coupled to the plurality of rails to selectively close the gateway for containing a solid object in the cavity.

2. The laundry accessory of claim 1, wherein the base has a planar configuration.

3. The laundry accessory of claim 1, wherein the one or more sidewalls have an arcuate configuration.

4. The laundry accessory of claim 1, wherein the body has a radially symmetrical configuration.

5. The laundry accessory of claim 1, wherein the gate is opposite the base such that the one or more sidewalls extend generally downward from the gate when the gate is in a closed position.

6. The laundry accessory of claim 1, wherein the gate has an arcuate configuration.

7. The laundry accessory of claim 1, wherein the gate is coupled to the plurality of rails such that an outer surface of the gate faces an inner surface of the one or more sidewalls when the gate is in an open position.

8. The laundry accessory of claim 1, wherein the body includes a plurality of openings extending therethrough, the plurality of openings sized to allow fluid to pass therethrough while restricting the solid object from passing therethrough.

9. The laundry accessory of claim 1, wherein the gate includes a plurality of openings extending therethrough, the plurality of openings sized to allow fluid to pass therethrough while restricting the solid object from passing therethrough.

10. The laundry accessory of claim 1, wherein the body includes a plurality of surface features at an inner surface of one or more of the base or the one or more sidewalls.

11. The laundry accessory of claim 1, wherein the gate includes a plurality of surface features at an inner surface of the gate.

12. The laundry accessory of claim 1, wherein the body include a plurality of surface features at an outer surface of one or more of the base or the one or more sidewalls.

13. The laundry accessory of claim 1, wherein the gate includes a plurality of surface features at an outer surface of the gate.

14. A container for protecting laundry, the container comprising:

a planar base;

one or more arcuate sidewalls extending generally upward from the planar base to at least partially define a cavity sized to accommodate the laundry;

a plurality of rails coupled to an upper portion of the one or more arcuate sidewalls, the plurality of rails defining a gateway in fluid communication with the cavity; and a gate coupled to the plurality of rails such that the gate is slidable between an open position, in which the laundry is allowed to move through the gateway, and a closed position, in which the laundry is restricted from moving through the gateway.

15. The container of claim 14, wherein the gate is opposite the planar base such that the one or more arcuate sidewalls extend generally downward from the gate when the gate is in the closed position.

16. The container of claim 14, wherein the gate has an arcuate configuration.

17. The container of claim 14, wherein an outer surface of the gate faces an inner surface of the one or more arcuate sidewalls when the gate is in the open position.

18. The container of claim 14, wherein the planar base, the one or more arcuate sidewalls, and the gate each include a plurality of openings extending therethrough, the plurality of openings sized to allow fluid to pass therethrough while restricting the laundry from passing therethrough.

19. The container of claim 14, wherein the planar base, the one or more arcuate sidewalls, and the gate each include a plurality of surface features.

20. A method of manufacturing an accessory for protecting laundry, the method comprising:

forming a body including a planar base and one or more arcuate sidewalls extending generally upward from the planar base to at least partially define a cavity sized to accommodate the laundry;

coupling a plurality of rails to an upper portion of the one or more arcuate sidewalls such that the plurality of rails define a gateway in fluid communication with the cavity; and coupling a gate to the plurality of rails such that the gate is slidable between an open position, in which the laundry is allowed to move through the gateway, and a closed position, in which the laundry is restricted from moving through the gateway.

* * * * *